United States Patent [19]

Schopp et al.

[11] Patent Number: 4,719,958

[45] Date of Patent: Jan. 19, 1988

[54] METHOD, APPARATUS AND FEEDER SLEEVES FOR THE PRODUCTION OF CASTING MOULDS

[75] Inventors: Helmut Schopp, Borken; Michael Friedrichs, Wesel, both of Fed. Rep. of Germany

[73] Assignee: Foseco International Ltd., Birmingham, England

[21] Appl. No.: 943,042

[22] Filed: Dec. 18, 1986

[30] Foreign Application Priority Data

Jan. 14, 1986 [DE] Fed. Rep. of Germany ..... 3600847

[51] Int. Cl.[4] ..... B22C 9/08; B22C 7/00

[52] U.S. Cl. ..... 164/29; 164/235; 164/243; 164/244; 164/360

[58] Field of Search ..... 164/29, 359, 360, 369, 164/137, 339, 340, 249, 239–244, 45, 235

[56] References Cited

U.S. PATENT DOCUMENTS

| | | | |
|---|---|---|---|
| 455,142 | 6/1891 | Adams | 164/249 |
| 917,371 | 4/1909 | Smith | 164/244 |
| 2,268,676 | 1/1942 | Shanley | 164/369 |
| 3,332,659 | 7/1967 | Urmetz et al. | 164/137 X |
| 3,467,173 | 9/1969 | Tisdale, Jr. | 164/359 X |
| 3,612,162 | 10/1971 | Michel | 164/340 X |

FOREIGN PATENT DOCUMENTS

| | | | |
|---|---|---|---|
| 183877 | 4/1955 | Austria | 164/340 |
| 502646 | 5/1951 | Belgium | 164/360 |
| 2907301 | 9/1980 | Fed. Rep. of Germany | 164/360 |
| 2928166 | 1/1981 | Fed. Rep. of Germany | 164/360 |
| 1257934 | 2/1961 | France | 164/137 |
| 47-28573 | 7/1972 | Japan | 164/359 |
| 48-25298 | 7/1973 | Japan | 164/369 |
| 546428 | 3/1977 | U.S.S.R. | 164/137 |

*Primary Examiner*—Kuang Y. Lin

*Attorney, Agent, or Firm*—Nixon & Vanderhye

[57] ABSTRACT

A method, apparatus and feeder sleeves are described for producing casting moulds having feeder sleeves incorporated therein in instances when the mould pattern plate or the cope mould are not accessible. Two part feeder patterns having a lower part and an upper part and feeder sleeves whose lateral surface tapers from the bottom and to the top end of the sleeve are used. For moulds having a side feeder the lower part of the pattern produces a depressed seating surface for the feeder sleeve in the drag mould and the upper part which has substantially the same taper as the taper of the feeder sleeve and dimensions greater than the corresponding dimensions of the lateral surface of the feeder sleeve produces a cavity in the cope mould. The cope and drag moulds are closed in such a manner that the central vertical axis of the cavity in the cope mould is in line with the central vertical axis of the feeder sleeve, and there is a gap between the wall of the cavity and the outer lateral surface of the sleeve. When metal is cast into the mould the sleeve floats up and sits firmly and is sealed against the wall of the cavity. For moulds having a top feeder the lower part of the pattern produces a depressed seating surface for a core whose upper surface has means for locating and centering the feeder sleeve.

20 Claims, 16 Drawing Figures

Figure 4:
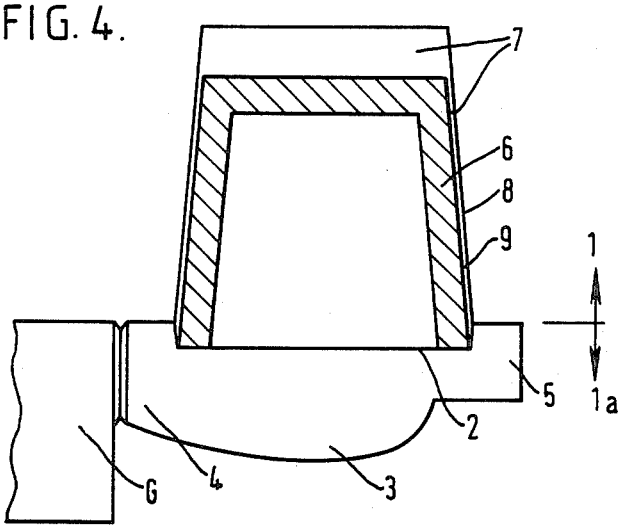

FIG. 1.
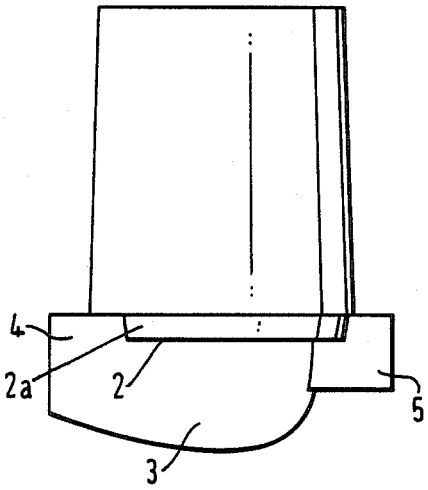
FIG. 2.
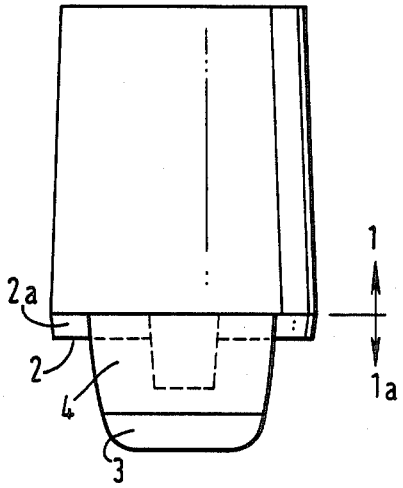
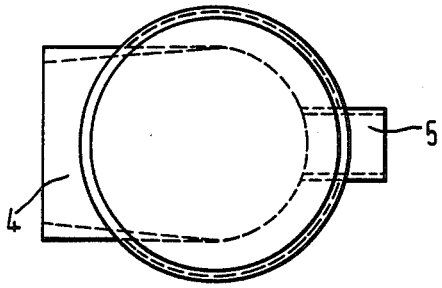
FIG. 3.

FIG. 10.
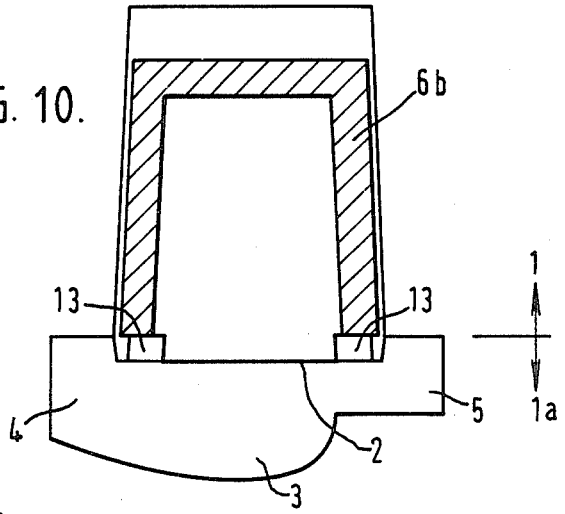
FIG. 8.
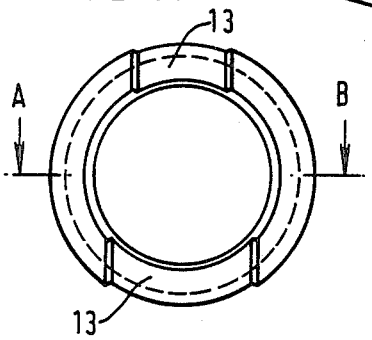
FIG. 11.
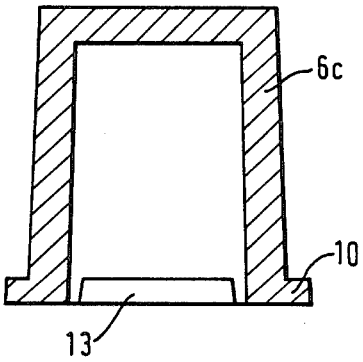
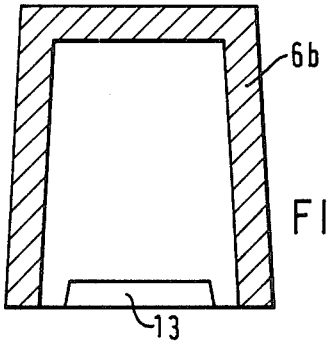
FIG. 9.

METHOD, APPARATUS AND FEEDER SLEEVES FOR THE PRODUCTION OF CASTING MOULDS

This invention relates to a method, apparatus and feeder sleeves for the production of casting moulds.

The use of feeder sleeves of exothermic and/or heat-insulating material in sand moulds for metal casting is well known, and several methods for incorporating feeder sleeves, which may be open at both ends or closed at one end, are practised.

In one method a feeder sleeve is located prior to moulding on a support fixed firmly to a casting pattern, or when the mould is to have a side feeder on a support fixed firmly to an extension of the casting pattern. After moulding the support is removed so as to produce a feeder cavity surrounded by the sleeve, which is held firmly in place. Either open or closed feeder sleeves may be incorporated in moulds using this method.

In another method cylindrical feeder sleeves or tapered feeder sleeves having a smaller diameter at their bottom end are inserted from above into a cavity formed by locating a separate feeder pattern on the casting pattern, or in the case of a side feeder on an extension of the casting pattern, moulding and then upwardly removing the separate feeder pattern. Both open and closed riser sleeves may be used in this method.

In another method a tapered riser sleeve is inserted into a cavity formed by a tapered pattern dummy having longitudinal recesses, the sleeve being held firmly in place by ribs of moulding sand produced by the recesses.

In order to incorporate feeder sleeves into casting moulds having a horizontal parting line, and consisting of a cope mould and a drag mould, it is necessary that either the casting pattern or the cope mould is accessible. There are however automatic moulding plants in which, for reasons of safety, the casting pattern is not accessible whilst the plants are operating, and where for reasons of design or safety the cope mould is also not accessible for the subsequent incorporation of feeder sleeves.

Because of this limitation, only so-called natural feeding techniques can be practised for the production of castings in such moulding plants. When using such techniques, feeder patterns are fixed to the pattern plate, and after moulding and removal from the mould they produce feeder cavities, surrounded by moulding sand and connected to the casting, which has to be fed.

Natural feeders in comparison with insulated and/or exothermically heated feeders of the same size, produced by incorporating feeder sleeves into the casting mould using the methods described above, have the disadvantage that they cool more quickly. In order to achieve the same solidification time as insulated or exothermically heated feeders, natural feeders must have a larger volume. For the commercial production of castings however this is a technical and economic disadvantage.

The object of the present invention is to create a method by means of which foundry moulds incorporating feeder sleeves can be produced even when the pattern plate and cope mould are not accessible.

According to the invention there is provided a method for the production of a metal casting mould comprising a cope mould and a drag mould and having, incorporated therein, a feeder sleeve whose outer lateral surface tapers from the bottom end of the feeder sleeve to the top end the method comprising (1) providing a two part feeder pattern consisting of a lower part and an upper part, the lower part having means for locating and centering the feeder sleeve in the mould, and the upper part having a lateral surface having substantially the same taper as the taper of the feeder sleeve and dimensions greater than the corresponding dimensions of the outer lateral surface of the feeder sleeve (2) fixing the lower part of the feeder pattern to a drag mould pattern plate and the upper part of the feeder pattern to a cope mould pattern plate (3) compacting particulate moulding material around the two parts of the feeder pattern and removing the two parts of the feeder pattern so as to produce a drag mould and a cope mould (4) locating the feeder sleeve in the mould and (5) closing the cope and drag moulds in such a manner that the central vertical axis of a cavity produced in the cope mould by the upper part of the pattern is in line with the central vertical axis of the feeder sleeve, and there is a gap between the wall of the cavity in the cope mould and the outer lateral surface of the feeder sleeve.

In one embodiment of the invention the method comprises (1) providing a two part feeder pattern consisting of a lower part and an upper part, the lower part having means for producing a depressed seating surface for the feeder sleeve in the drag mould, and the upper part having a lateral surface having the substantially same taper as the taper of the feeder sleeve and dimensions greater than the corresponding dimensions of the outer lateral surface of the feeder sleeve (2) fixing the lower part of the feeder pattern to a drag mould pattern plate (3) compacting particulate moulding material around the lower part of the feeder pattern (4) removing the lower part of the feeder pattern so as to produce in the drag mould the depressed seating surface for locating and centering the feeder sleeve (5) seating the feeder sleeve on the depressed surface (6) fixing the upper part of the feeder pattern to a cope mould pattern plate (7) compacting particulate moulding material around the upper part of the feeder pattern (8) removing the upper part of the feeder pattern so as to produce in the cope mould a cavity and (9) closing the cope and drag moulds in such a manner that the central vertical axis of the cavity in the cope mould is in line with the central vertical axis of the feeder sleeve, and there is a gap between the wall of the cavity in the cope mould and the outer lateral surface of the feeder sleeve.

As the cavity produced in the cope mould by the upper part of the two part feeder pattern is larger in all its dimensions than the feeder sleeve located in the drag mould the feeder sleeve does not come into contact with the walls of the cope mould cavity when the cope mould and the drag mould are joined together.

As a result the sleeve is not displaced when the cope and drag moulds are joined together and moulding material cannot be rubbed off the cavity wall and fall into the mould or the mould runner.

The air gap which is deliberately produced around the external surface of the feeder sleeve must be sealed when metal is cast into the mould otherwise molten metal would flow around the feeder sleeve and gases produced during casting, for example by combustion of the feeder sleeve, would not be able to escape to the atmosphere. The flow of metal around the feeder sleeve is avoided because during casting the feeder sleeve floats up with the rising cast metal and its tapered outer surface sits firmly and is sealed against the wall of the similarly tapered cavity in the cope mould.

In order to allow for slight variations from the nominal dimensions of a particular feeder sleeve when producing large quantities of that sleeve the upper part of the feeder pattern may be such that its lateral surface is in all its dimensions larger than the corresponding dimensions of the outer lateral surface of the feeder sleeve by more than three times the standard deviation from the mean of those dimensions.

In order to produce the required depressed seating surface for the feeder sleeve in the drag mould the lower part of the two part feeder pattern may contain a plate having a thickness corresponding to the desired depth of the depression, and to allow for production variations in feeder sleeves of a particular nominal size the lateral dimensions of the plate preferably correspond to the dimensions of the outer lateral surface of the feeder sleeve at the bottom end of the feeder sleeve plus three times the standard deviation from the mean of those dimensions.

In addition to the plate for producing the depressed seating surface for the feeder sleeve the lower part of the two part feeder pattern preferably also contains in one piece parts for producing a feeder base, a feeder neck and optionally a feeder ingate.

Partial penetration of molten metal behind the feeder sleeve due to dimensional variations resulting from the production method used for making the sleeves can also be prevented by providing the sleeve with a rim at its bottom end and using a two part feeder pattern whose upper part has a similar rim at its bottom end. By making the thickness of the rim at the base of the feeder sleeve smaller than the total thickness of the plate in the lower part of the feeder pattern and the rim at the base of the upper part of the feeder pattern contact between the rim on the feeder sleeve and the cope mould when the cope mould and drag mould are joined together is prevented, and the feeder sleeve can float upwards with the rising metal on casting and provide an additional seal on the upper face of the rim.

In another embodiment the feeder sleeve may have at its bottom end one or more lateral openings. These openings are located above the feeder neck and the feeder in-gate after the feeder sleeve has been set in the drag mould so that the cast metal which flows from the ingate into the feeder base and through the feeder neck into the casting does not come into contact with the feeder sleeve until the end of mould filling when the upwards flotation of the feeder sleeve takes place. Thereby it is ensured that the cast metal does not displace prematurely and flow behind the feeder sleeve standing loosely in the casting mould thus preventing subsequent accurate upward flotation.

At the same time with this form of feeder sleeve the cast metal flowing into the mould past the lower edge of the feeder sleeve does not produce any turbulence and wash-off which would influence the success of casting.

The foregoing description of the invention concerns a method, as well as feeder patterns and feeder sleeves for carrying out the method, in order to feed a casting from side feeders. Dependent on the position of a casting in the mould it is possible to define for all castings top and side surfaces. Side feeders are cavities located next to and connected by means of a feeder base and a feeder neck to the side surfaces of the casting cavity in the mould, as a rule close to the mould parting line between the cope and drag mould.

In some cases it is however necessary that feeders are located directly on the top surface of a casting, and this practice is known as top feeding.

The method of the invention can be adapted to top feeding practice by locating a core in the drag mould and locating the feeder sleeve on the core.

According therefore to another embodiment of the invention the method comprises (1) providing a two part feeder pattern consisting of a lower part and an upper part, the lower part having means for producing in the drag mould a depressed seating surface for a core and the upper part having a lateral surface having substantially the same taper as the taper of the feeder sleeve and dimensions greater than the corresponding dimensions of the outer lateral surface of the feeder sleeve (2) fixing the lower part of the feeder pattern to a drag mould pattern plate (3) compacting particulate moulding material around the lower part of the feeder pattern (4) removing the lower part of the feeder pattern so as to produce in the drag mould the depressed seating surface for locating and centering the core.

(5) seating a core having an upper and lower surface and one or more apertures extending from the upper to the lower surface, the upper surface having means for locating and centering the feeder sleeve, on the depressed surface in the drag mould (6) seating the feeder sleeve on the upper surface of the core about the locating and centering means (7) fixing the upper part of the feeder pattern to a cope mould pattern plate (8) compacting particulate moulding material around the upper part of the feeder pattern (9) removing the upper part of the feeder pattern so as to produce in the cope mould a cavity and

(10) closing the cope and drag moulds in such a manner that the central vertical axis of the cavity in the cope mould is in line with the central vertical axis of the feeder sleeve, and there is a gap between the wall of the cavity in the cope mould and the outer lateral surface of the feeder sleeve.

When molten metal is cast into the mould the feeder sleeve floats up and seals itself against the wall of the cavity in the cope mould while the core remains firmly in position.

The bottom part of the feeder pattern no longer contains the elements necessary for side feeding practice such as the feeder sleeve seating surface, the feeder base and the feeder neck but only one or more centering parts which, in the moulded up condition produce depressions in the drag mould for locating the core. The core which may have one or more centering rims on its lower side is set into the depressions in the drag mould and bridges over the walls of a casting cavity which is lying in the drag mould.

So that the solidifying casting can be fed from above through the core the core contains one or more breaker core-like apertures located above the top surface of the casting. Furthermore, the core contains in its upper face a feeder sleeve seating surface and centering means such as one or more rims for the feeder sleeve which is to be located on the surface.

The feeder sleeve may be fixed on to the core by means of internal or external centering. Preferably the lateral dimensions of the centering rim which locates the feeder sleeve correspond to the average lateral dimensions of the feeder sleeve at its bottom end plus a maximum of three times the standard deviation for external centering or minus a maximum of three times the standard deviation for internal centering.

The upper part of the feeder pattern has at its base a surrounding rim whose dimensions conform to the external dimensions of the core plus a maximum of three times the standard deviation from the mean of the respective core dimensions so that the portion of the core which projects into the cope mould is tightly enclosed at its outer perimeter when the cope and drag moulds are closed together. As a result the cover core is not able to float upwards with the rising cast metal during casting.

The lateral surface of the upper part of the feeder pattern is in all of its dimensions larger than the corresponding dimensions of the outer lateral surface of the feeder sleeve by more than three times the standard deviation from the mean dimensions.

In addition to the methods described for producing a casting mould containing a feeder sleeve the invention also includes two part feeder patterns, cores and feeder sleeves as described herein.

Figure 5:
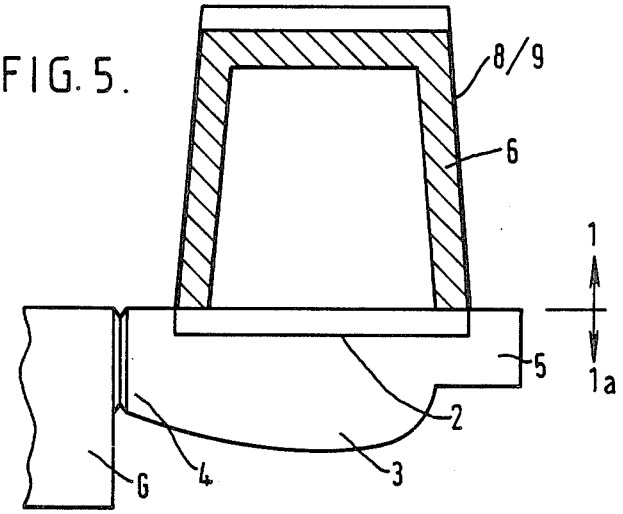
Figure 6:
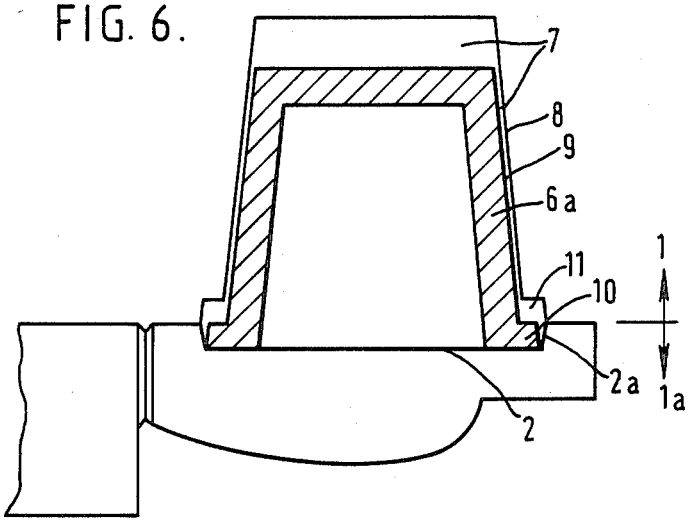
Figure 7:
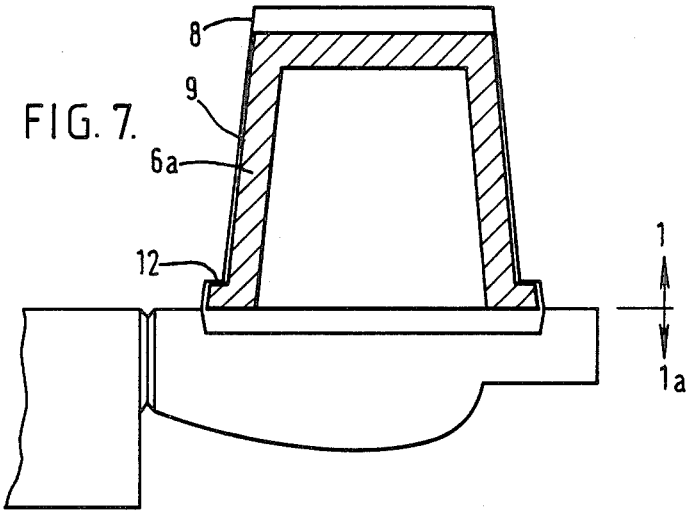

The invention is illustrated with reference to the accompanying drawings in which:

FIGS. 1, 2 and 3 show a front view, side view and a top plan view respectively of a two part feeder pattern according to the invention for producing a side feeder cavity in a casting mould FIG. 4 shows schematically a section through a closed casting mould produced using the feeder pattern of FIGS. 1–3 and through a feeder sleeve standing in the drag mould, before casting FIG. 5 shows in a manner analagous to FIG. 4 the position of the feeder sleeve after casting FIG. 6 shows schematically a section through a closed casting mould and through a feeder sleeve standing in the drag mould, before casting, the mould having been produced using a two part feeder pattern whose upper part has a surrounding rim, and the feeder sleeve also having a surrounding rim FIG. 7 shows in a manner analagous to FIG. 6 the position of the feeder sleeve after casting FIG. 8 shows a view from below of a feeder sleeve with lateral openings at its bottom end FIG. 9 is a vertical section along the line A - B of the feeder sleeve shown in FIG. 8

Figure 12:
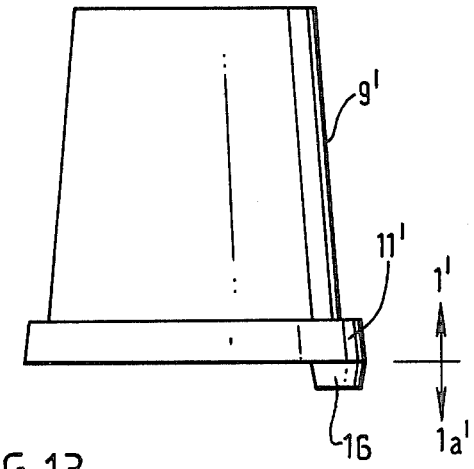
Figure 13:
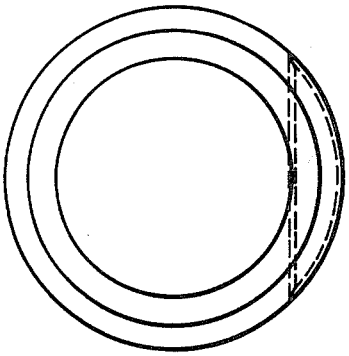
Figure 14:
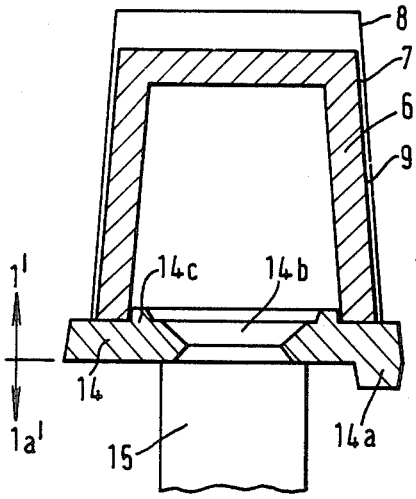
Figure 15:
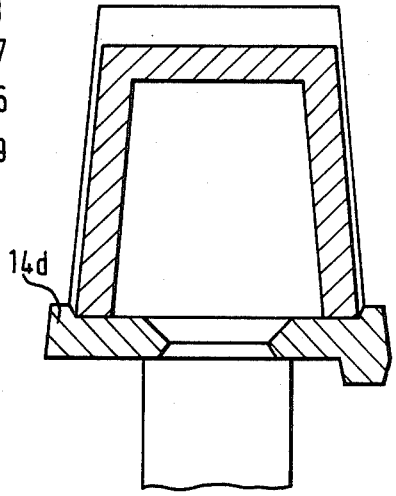
Figure 16:
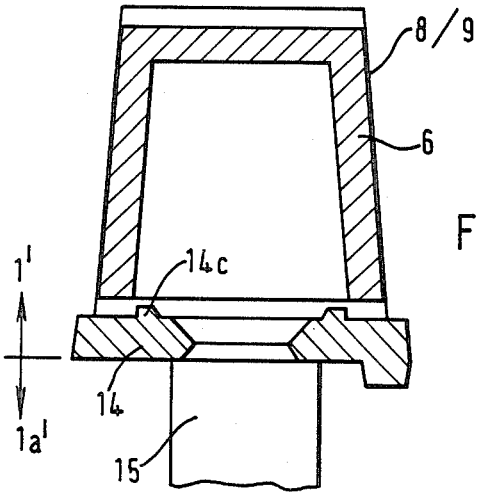

FIG. 10 shows schematically a section through a closed casting mould and the feeder sleeve with openings shown in FIGS. 8 and 9 standing in the drag mould, before casting FIG. 11 shows a drawing in section of a feeder sleeve with surrounding rim and openings according to the invention FIGS. 12 and 13 show a front view and a top plan view respectively of a two part feeder pattern according to the invention for producing a top feeder in a casting mould FIG. 14 shows schematically a vertical section through a closed casting mould containing a core located in the mould and having means for internal centering of a feeder sleeve, before casting FIG. 15 is analagous to FIG. 14 except that the core has means for external centering of the feeder sleeve and FIG. 16 shows schematically a vertical section through the mould shown in FIG. 14, after casting. The feeder sleeve has floated upwards whilst the core has been held firmly in its position.

Referring to FIGS. 1–5, the parting line of a two part feeder pattern is drawn in between the feeder pattern upper part 1 and the feeder pattern lower part 1*a*. In use the feeder pattern lower part 1*a* is fixed to a drag pattern plate; the feeder pattern upper part 1 is fixed centrally and symmetrically with the axis of the lower part 1*a* on to a cope pattern plate. The feeder pattern upper part 1 has an outer surface which tapers from bottom to top at a desired angle.

The feeder pattern lower part 1*a* contains in one piece a seating surface 2 for a feeder sleeve 6, a feeder base 3, a feeder neck 4 and a feeder in-gate 5. The seating surface 2 for the feeder sleeve 6 is produced by means of a plate 2*a* of desired thickness which is part of the lower part of the feeder pattern 1*a*. The plate 2*a* overlaps outwardly with and projects into that section of the feeder pattern forming the feeder neck 4, the feeder base 3 and the feeder in-gate 5. The outer lateral dimensions of the seating surface 2 of the feeder pattern corresponds to the dimensions of the outer lateral surface at the bottom end of the feeder sleeve plus a maximum of three times the standard deviation from the mean of those dimensions. The feeder neck 4 after casting joins the feeder base 3 with the casting. The feeder in-gate 5 is connected on the pattern plate with the running system (not shown). In FIG. 4 the feeder sleeve 6 stands in the drag of a closed casting mould on the feeder sleeve seating surface 2 and the outside surface of the feeder sleeve is surrounded on all sides by an air gap 7. The air gap is deliberately created by the fact that the upper part 1 of the two part feeder pattern 1/1*a* is larger in all of its dimensions than the feeder sleeve 6 located on the seating surface 2 in the drag mould. In particular, the lateral surface of the upper part 1 of the feeder pattern is larger than the corresponding dimensions of the outer lateral surface of the feeder sleeve by more than three times the standard deviation from the mean of those dimensions. In this way contact with wall 8 of the cavity in the cope mould by the feeder sleeve 6 when the cope mould and drag mould are closed together is avoided. Furthermore the feeder sleeve 6 is not displaced, and no moulding sand can be dislodged and fall into the feeder base 3, from which during pouring it could be washed into the casting. As shown in FIG. 5, after the mould has been filled with molten metal the feeder sleeve has floated upwards and its outside surface 9 has been firmly seated and sealed against the similarly tapered wall 8 of the surrounding cavity in the cope mould.

Referring to FIGS. 6 and 7 a cope mould is produced using a feeder pattern whose upper part 1 possesses at its bottom end a surrounding rim which forms a ring shaped cavity 11. As shown in FIG. 6 feeder sleeve 6*a* has at its bottom end where it sits on the feeder sleeve seating surface 2 a surrounding rim 10, and the outside surface 9 of the feeder sleeve 6*a* is surrounded on all sides by an air gap 7. The thickness of the surrounding rim 10 is smaller than the total thickness of the plate 2*a* of the lower part 1*a* of the feeder pattern and the surrounding rim of the upper part 1 of the feeder pattern so that the surrounding rim 10 is not touched by the cope mould when the two mould parts are closed together. FIG. 7 shows the feeder sleeve 6*a* in position after floating as it would be after the mould has been filled.

During the course of production of feeder sleeves some dimensional variations due to factors of the production method may occur, and as a result, for example, the outside surface of the feeder sleeve may not be exactly smooth and may not have at all points on its surface the desired taper. If such a feeder sleeve is used it can occur after the sleeve has floated that the outer surface 9 of the feeder sleeve only seats firmly against the tapered walls 8 of the surrounding cavity in the cope mould over part of its area, and as a result only achieves a partial seal. For such cases the embodiments of the invention shown in FIGS. 6 and 7 are particularly suitable because an additional and effective sealing surface is created on the upper edge 12 of the surrounding rim 10 of the feeder sleeve 6*a*.

Referring to FIGS. 8–10 a feeder sleeve 6*b* has two lateral openings 13 located essentially diametrically opposite one from the other at its bottom end. The feeder sleeve 6*b* is located on the seating surface 2 in such a manner that the openings 13 are located above the feeder neck 4 and above the feeder in-gate 5. As a result during casting the full section of the feeder neck 4 and the feeder in-gate 5 is available so that the cast metal flowing into the feeder base 3 and from there into the casting cavity does not come into contact with the lower edge of the feeder sleeve 6*b* until the feeder sleeve 6*b* floats upwards with the rising cast metal at the end of filling the mould. In this manner any washing effect or tubulence by the cast metal on the lower edge of the feeder sleeve 6*b* is minimised. This becomes clear by a comparison of FIGS. 6 and 10, and it can be seen from FIG. 10 that the feeder neck 4 and the feeder in-gate 5 are no longer constricted and that the ability of the feeder sleeve to float upwards and seal is not affected.

Referring to FIG. 11 a feeder sleeve 6*c* has both a surrounding rim 10 and lateral openings 13 at its bottom end. As in the case of the feeder sleeve 6*a* shown in FIGS. 6 and 7 the surrounding rim 10 has a thickness which is smaller than the total thickness of the plate of the bottom part of the feeder pattern and the surrounding rim of the top part of the feeder pattern with which the sleeve is to be used.

Referring to FIGS. 12–16 the parting line of a two part feeder pattern is indicated between the feeder pattern's upper part 1′ and the feeder pattern's lower part 1*a*′. The feeder pattern's lower part 1*a*′ consists of one or more centering means 16 and is fixed to a drag pattern plate, and after moulding a depression is formed in the drag mould and serves as a means of centering for a core 14 which is to be located therein. The feeder pattern's upper part 1′ possesses at its bottom end a surrounding rim 11′ which conforms in its dimensions to the external dimensions of the core 14 plus a maximum of three times the standard deviation from the mean of the respective core dimensions. Above the rim 11′ the feeder pattern's upper part has an external surface 9′ tapering from bottom to top at a desired angle.

In FIG. 14 the core 14 spans over a casting cavity wall 15 which is lying in the drag mould. The core 14 is fixed with its centering rim 14*a* in the drag mould depression which was formed by the centering means 16 of the feeder pattern's lower part 1*a*. The core 14 has above the casting wall 15 a breaker core-like aperture 14*b* through which feed metal flows into the casting due to the solidification shrinkage of the casting. Further the core 14 also has on its upper face a surrounding rim 14*c* as a means of centering for the feeder sleeve 6. The feeder sleeve 6 standing on the core 14 in the enclosed casting mould is surrounded around its external surface by an air gap 7. The air gap is produced by the fact that the lateral surface of the upper part 1′ of the two part feeder pattern 1′+1*a*′ is in all of its dimensions larger than the outer lateral surface of the feeder sleeve 6 located in the drag mould on the core 14. In this manner contact with the walls 8 of the cavity in the cope mould by the feeder sleeve 6 when the mould parts are closed together is avoided. Furthermore the feeder sleeve 6 is not displaced and no moulding sand is rubbed off to fall into the drag mould. In FIG. 14 the feeder sleeve 6 is centered internally by means of the centering rim 14*c* of the core 14. FIG. 15 shows a modified form where the core 14 possesses at its outside edge a centering rim 14*d* by means of which the feeder sleeve 6 is centered by its external surface. When using such a core 14 the rim 11′ on the upper part of the feeder pattern 1′ must be correspondingly shaped. FIG. 16 shows that after the mould of FIG. 14 has filled the feeder sleeve has floated upwards and has seated itself firmly so as to form a seal between its external surface 9 and the similarly tapered walls 8 of the surrounding cavity of the cope mould.

We claim:

1. A method for the production of a metal casting mould comprising a cope mould and a drag mould and having, incorporated therein, a feeder sleeve whose outer lateral surface tapers from the bottom end of the feeder sleeve to the top end, the method comprising (1) providing a two part feeder pattern consisting of a lower part and an upper part, the lower part having means for locating and centering the feeder sleeve in the mould, and the upper part having a lateral surface having substantially the same taper as the taper of the feeder sleeve and dimensions greater than the corresponding dimensions of the outer lateral surface of the feeder sleeve (2) fixing the lower part of the feeder pattern to a drag mould pattern plate and the upper part of the feeder pattern to a cope mould pattern plate (3) compacting particulate moulding material around the two parts of the feeder pattern and removing the two parts of the feeder pattern so as to produce a drag mould and a cope mould (4) locating the feeder sleeve in the mould and (5) closing the cope and drag moulds in such a manner that the central vertical axis of a cavity produced in the cope mould by the upper part of the pattern is in line with the central vertical axis of the feeder sleeve, and there is a gap between the wall of the cavity in the cope mould and the outer lateral surface of the feeder sleeve.

2. A method for the production of a metal casting mould comprising a cope mould and a drag mould and having, incorporated therein, a feeder sleeve whose outer lateral surface tapers from the bottom end of the feeder sleeve to the top end, the method comprising (1) providing a two part feeder pattern consisting of a lower part and an upper part, the lower part having means for producing a depressed seating surface for the feeder sleeve in the drag mould, and the upper part having a lateral surface having the substantially same taper as the taper of the feeder sleeve and dimensions greater than the corresponding dimensions of the outer lateral surface of the feeder sleeve (2) fixing the lower part of the feeder pattern to a drag mould pattern plate (3) compacting particulate moulding material around the lower part of the feeder pattern (4) removing the lower part of the feeder pattern so as to produce in the drag mould the depressed seating surface for locating and centering the feeder sleeve (5) seating the feeder sleeve on the depressed surface (6) fixing the upper part of the feeder pattern to a cope mould pattern plate (7) compacting particulate moulding material around the upper part of the feeder pattern (8) removing the upper part of the feeder pattern so as to produce in the cope mould a cavity and (9) closing the cope and drag moulds in such a manner that the central vertical axis of the cavity in the cope mould is in line with the central vertical axis of the feeder sleeve, and there is a gap between the wall of the cavity in the cope mould and the outer lateral surface of the feeder sleeve.

3. A method according to claim 2 wherein the lateral surface of the upper part of the feeder pattern is in all its dimensions larger than the corresponding dimensions of the outer lateral surface of the feeder sleeve by more than three times the standard deviation from the mean of those dimensions.

4. A method according to claim 2 wherein the lower part of the feeder pattern contains a plate having a thickness corresponding to the desired depth of the depressed seating surface for the feeder sleeve.

5. A method according to claim 4 wherein the lateral dimensions of the plate correspond to the dimensions of the outer lateral surface of the feeder sleeve at the bottom end of the feeder sleeve plus three times the standard deviation from the mean of those dimensions.

6. A method according to claim 4 wherein the lower part of the feeder pattern also contains parts for producing a feeder base, a feeder neck and a feeder ingate.

7. A method according to claim 4 wherein the feeder sleeve and the upper part of the feeder pattern each have a rim at their bottom end and the thickness of the rim at the bottom end of the feeder sleeve is smaller than the total thickness of the plate in the lower part of the feeder pattern and the rim at the bottom end of the upper part of the feeder pattern.

8. A method according to claim 2 wherein the feeder sleeve has at its bottom end one or more lateral openings.

9. A method for the production of a metal casting mould comprising a cope mould and a drag mould and having, incorporated therein, a feeder sleeve whose outer lateral surface tapers from the bottom end of the feeder sleeve to the top end, the method comprising (1) providing a two part feeder pattern consisting of a lower part and an upper part, the lower part having means for producing in the drag mould a depressed seating surface for a core and the upper part having a lateral surface having substantially the same taper as the taper of the feeder sleeve and dimensions greater than the corresponding dimensions of the outer lateral surface of the feeder sleeve (2) fixing the lower part of the feeder pattern to a drag mould pattern plate (3) compacting particulate moulding material around the lower part of the feeder pattern (4) removing the lower part of the feeder pattern so as to produce in the drag mould the depressed seating surface for locating and centering the core (5) seating a core having an upper and lower surface and one or more apertures extending from the upper to the lower surface, the upper surface having means for locating and centering the feeder sleeve, on the depressed surface in the drag mould (6) seating the feeder sleeve on the upper surface of the core about the locating and centering means (7) fixing the upper part of the feeder pattern to a cope mould pattern plate (8) compacting particulate moulding material around the upper part of the feeder pattern (9) removing the upper part of the feeder pattern so as to produce in the cope mould a cavity and

(10) closing the cope and drag moulds in such a manner that the central vertical axis of the cavity in the cope mould is in line with the central vertical axis of the feeder sleeve, and there is a gap between the wall of the cavity in the cope mould and the outer lateral surface of the feeder sleeve.

10. A method according to claim 9 wherein the core has on its lower surface one or more rims which are set into depressions produced by the lower part of the feeder pattern.

11. A method according to claim 9 wherein the upper surface of the core has one or more rims for centering the feeder sleeve.

12. A method according to claim 11 wherein the feeder sleeve is located by an internal centering rim.

13. A method according to claim 12 wherein the lateral dimensions of the external surface of the centering rim correspond to the average lateral dimensions of the feeder sleeve at its bottom end minus a maximum of three times the standard deviation.

14. A method according to claim 11 wherein the feeder sleeve is located by an external centering rim.

15. A method according to claim 14 wherein the lateral dimensions of the internal surface of the centering rim correspond to the average lateral dimensions of the feeder sleeve at its bottom end plus a maximum of three times the standard deviation.

16. A method according to claim 9 wherein the upper part of the feeder pattern has at its base a surrounding rim whose dimensions conform to the external dimensions of the core plus a maximum of three times the standard deviation from the mean of the respective core dimensions.

17. A method according to claim 9 wherein the lateral surface of the upper part of the feeder pattern is in all of its dimensions larger than the corresponding dimensions of the outer lateral surface of the feeder sleeve by more than three times the standard deviation from the mean dimensions.

18. A two part feeder pattern for producing a feeder cavity in casting mould, said pattern comprising a lower part adapted to be secured to a drag pattern plate and an upper part adapted to be secured to cope pattern plate, said upper part having an outer surface which tapers along substantially its entire length, wherein said lower pattern part includes means for forming in said feeder cavity, surfaces for seating and centering a feeder sleeve.

19. A two part feeder pattern according to claim 18 wherein the lower pattern part is formed with surfaces for producing a feeder base, a feeder neck and a feeder in-gate in said casting mould.

20. A two part feeder pattern according to claim 18 wherein said upper pattern part is provided at its lower end with a radially outwardly extending rim, and said lower pattern part is provided with surface means for forming one or more depressions in said casting mould for centering a core.

* * * * *